United States Patent [19]

Chen

[11] Patent Number: 4,833,983

[45] Date of Patent: May 30, 1989

[54] ADJUSTMENT APPARATUS FOR ADJUSTING THE SPEED OF A PLATE ROLLER RELATIVE TO A PRESSING ROLLER IN A MULTI-COLOR PLASTIC BAG PRINTER

[76] Inventor: Chun-Shan Chen, No. 48, Kuang Ming St., Hsin Shih Shiang, Tainan Hsien, Taiwan

[21] Appl. No.: 151,587

[22] Filed: Feb. 2, 1987

Related U.S. Application Data

[63] Continuation-in-part of Ser. No. 864,819, May 15, 1986, abandoned.

[51] Int. Cl.[4] ..... B41F 5/06; B41F 13/12

[52] U.S. Cl. ..... 101/181; 101/248

[58] Field of Search ..... 101/248, 181, 216; 226/30, 31, 37, 42, 27

[56] References Cited

U.S. PATENT DOCUMENTS 3,742,849 7/1973 Greiner ..... 101/248

4,363,270 12/1982 Ury et al. ..... 101/181 X

*Primary Examiner*—J. Reed Fisher

[57] ABSTRACT

This invention relates to an adjusting apparatus for adjusting the speed of a plate roller relative to a pressing roller for achieving registration between a plurality of printing means comprising a driving shaft at one end of which is a pressing roller. The adjusting apparatus further includes first and second transmission gear wheels, both of which are mounted on a transmission shaft. The first transmission gear wheel engages a main gear wheel which may be coupled to the driving shaft by a first clutch. The second transmission gear wheel engages an adjustment gear wheel which may be coupled to the driving shaft by a second clutch. First and second clutches are electrically operated such that only one clutch is operative at any time. Thus, when the first clutch is engaged, the main gear wheel is coupled to the driving shaft and drives the first transmission gear wheel and a plate cylinder driven gear wheel to drive the plate cylinder at a first speed. Alternately, when the second clutch is engaged, the adjustment gear having less teeth than the main drive gear, is coupled to the driving shaft and therefore powers the second transmission gear wheel which in turn is coupled to the first transmission gear wheel, driving the main gear wheel and the plate cylinder driven gear. Thus, the plate cylinder is now operated at a second speed by virtue of the gear ratio between the adjustment gear wheel and the second transmission gear wheel.

7 Claims, 4 Drawing Sheets

ADJUSTMENT APPARATUS FOR ADJUSTING THE SPEED OF A PLATE ROLLER RELATIVE TO A PRESSING ROLLER IN A MULTI-COLOR PLASTIC BAG PRINTER

REFERENCES TO RELATED PATENT APPLICATIONS

This patent application is a continuation-in-part of patent application Ser. No. 864,819, filed on May 15, 1986, now abandoned, entitled "AN ADJUSTMENT APPARATUS OF COLOR SUPERIMPOSEMENT FOR PLASTIC BAG PRINTER".

BACKGROUND OF THE INVENTION

Field of the Invention

Two color printing machines are predominantly used in plastic bag printing presses of the type shown in FIG. 3. As shown in the Figure, the prior art plastic bag printing machine 1 comprises a plastic bag wheel 11 which passes through a first printing means 12 to a second printing means 13 for application of the second color. The plastic bags are rolled to a drying means 18 and then collected on another plastic bag wheel 19. The first and second printing means 12 and 13 respectively comprises a rubber cylinder 14, an intermediate cylinder 15, a plate cylinder 16, and a pressing cylinder 17. In printing, the above plate cylinder 16 comes in contact with a set of inking rollers, not shown. For adjustment of the speed of the plate cylinder relative to the pressing cylinder, an adjustment device may be provided on one side of the plate cylinder 16.

A prior art adjustment device for use on the printing press of FIG. 3 is shown in FIG. 4. A fixing ring 7 is fitted on a main shaft 4 and a gear ring 5. The gear ring 5 is provided with an internal helical thread to engage with another helical thread provided on a sleeve 6 which is secured on the driving shaft 4. The relative motion between the gear ring 5 and the sleeve 6 will cause the driving shaft 4 to slide axially. The driving shaft 4 is provided with a first bevel gear 8 on one end and the pressing roller 17 at the other end (not shown). A second bevel gear 81 which is provided at one end of a driven shaft 333 engages with the first bevel gear 8. The driven shaft 333 is secured through bearings in a mounting member which is located in a housing 300. When the gear ring 5 and the sleeve 6 rotate, one relative to the other, such causes the driving shaft 4 to slide, causing a longitudinal shift x between the first bevel gear 8 and the second bevel gear 81. This also results in an axial shift y between the bevel gears. The axial shift between the first bevel gear 8 and the second bevel gear 81 causes the contacting position of pressing roller 17 and plate roller 16 to correspondingly shift to a new contacting position. Thus, the position on the plate roller 16 for registration of one color on the plastic bag will shift to a desired position.

However, there are many problems associated with the prior art system. First, the distance between the upper printing means and the lower printing means is limited by the size of the bevel gears. If a greater adjustment of distance is required, the interruption of printing is the only way to accomplish this. Second, the small contacting volume of the bevel gears will frequently cause their disengagement. Third, the speed of operation in printing is slow.

One object of this invention is to provide an adjustment apparatus for multi-color plastic bag printers which overcomes the problems of the prior art.

Other objects, merits a fuller understanding of the present invention will be obtained by those having ordinary skill in the art when the following detailed description of the preferred embodiment of the invention is read in conjunction with accompanying drawings wherein like numerals refer to like or similar parts and in which:

DETAILED DESCRIPTION OF THE PREFERRED EMBODIMENTS

Figure 1:
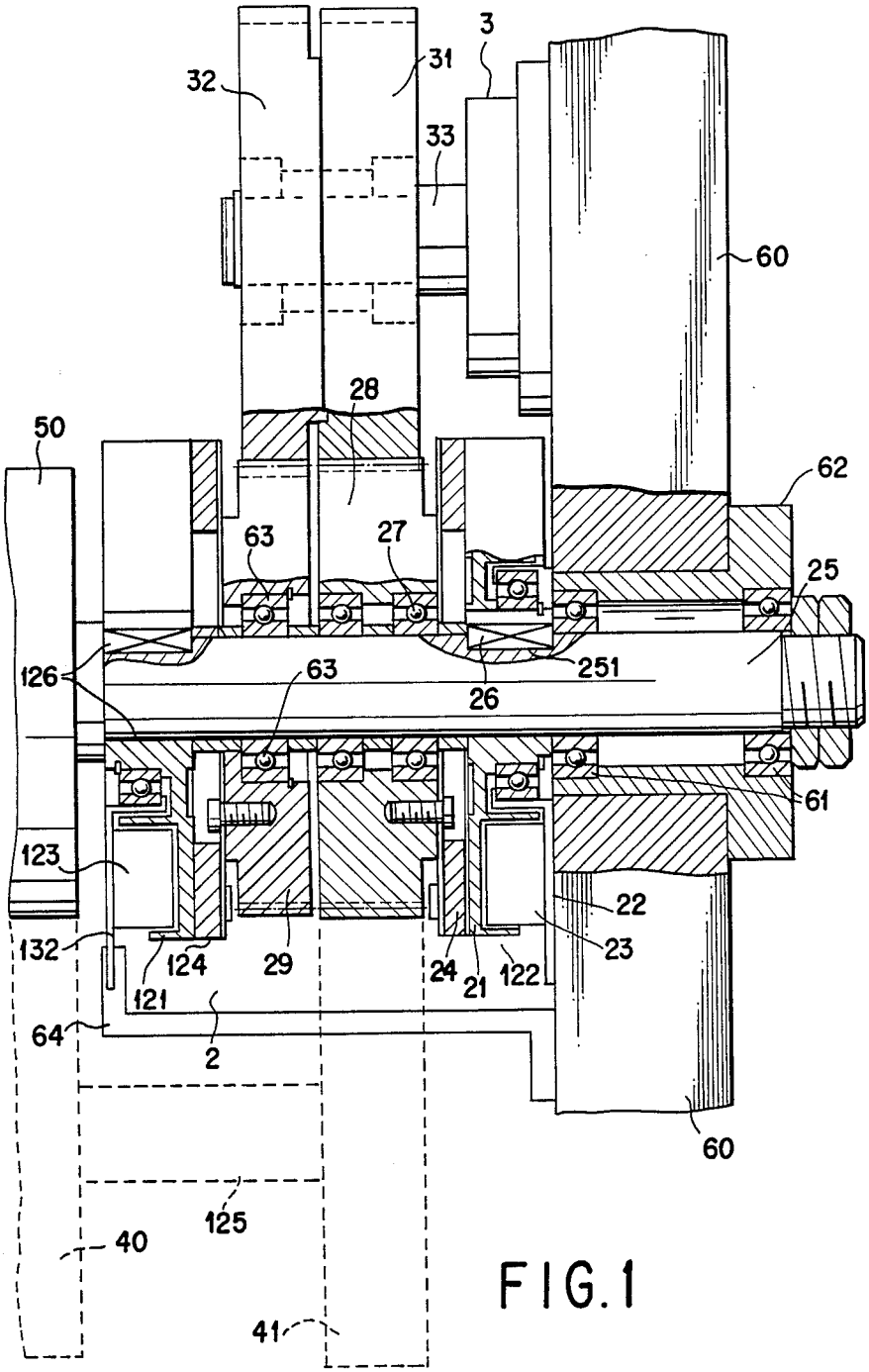
FIG. 1 is a sectional view of a preferred embodiment of this invention.

As shown in FIG. 1, the pressing roller or cylinder 17 mounted on a driving shaft 17 comes in contact with a plate cylinder 16 which is coupled to a driven gear wheel 41 by a shaft 125. The driven gear wheel 41 engages with a main gear wheel 28 which is mounted on the driving shaft 25. Thus, the driving shaft 25 is secured through bearings 61 in a mounting member 62 which is located in a housing 60. The pressing cylinder or roller 17 comes into contact with the plate cylinder 16 which is secured on the shaft 125 and is driven by gear wheel 41 which is also secured on shaft 125. The driven gear wheel 41 engages main gear wheel 28 which is mounted through bearings 27 on driving shaft 25. Adjustment gear wheel 29 is mounted through bearings 63 on driving shaft 25 adjacent to the main gear wheel 28. The main gear wheel 28 and the adjustment gear wheel 29 mesh respectively with a first transmission gear wheel 31 and a second transmission gear wheel 32 both of which are mounted on a transmission shaft 33. The transmission shaft 33, the first and second transmission gear wheels 31 and 32, constitute a transmission means 3.

Thus, the main gear wheel 28 and the adjustment gear wheel 29 mesh respectively with the first transmission gear wheel 31 and the second transmission gear wheel 32, both of which are mounted for rotation with a transmission shaft 33 which is supported through bearings (not shown) in the housing 60.

A clutch assembly includes two clutches 2 and 122 mounted on the driving shaft 125. The first clutch 122 comprises a stationary plate 22 fixed on a housing 60 and sleeved on the driving shaft 25 (shown in FIG. 1), the stationary plate 22 being provided with an electromagnetic member 23 thereon, a clutch slip plate 24 mounted on the driving shaft 25, and a clutch ring 22 rigidly mounted on the driving shaft 25 by means of a pin 26 through the pin cavity 251 on the driving shaft 25. Between the main gear wheel 28 and the driving shaft 25 is a bearing 27.

Figure 2:
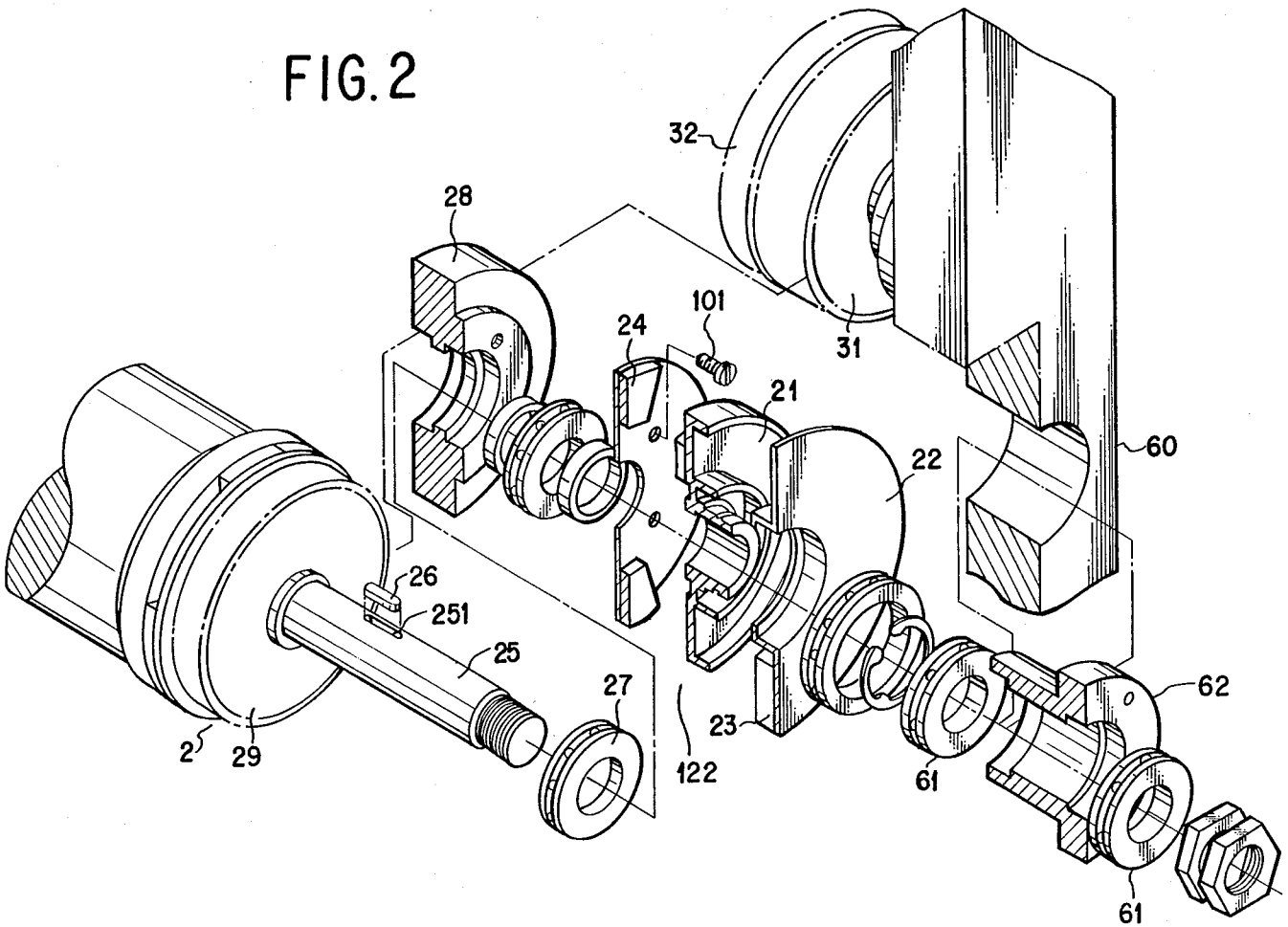
FIG. 2 is a fragmentary exploded view in perspective of a preferred embodiment of this invention, partially disassembled and taken off.
Figure 3:
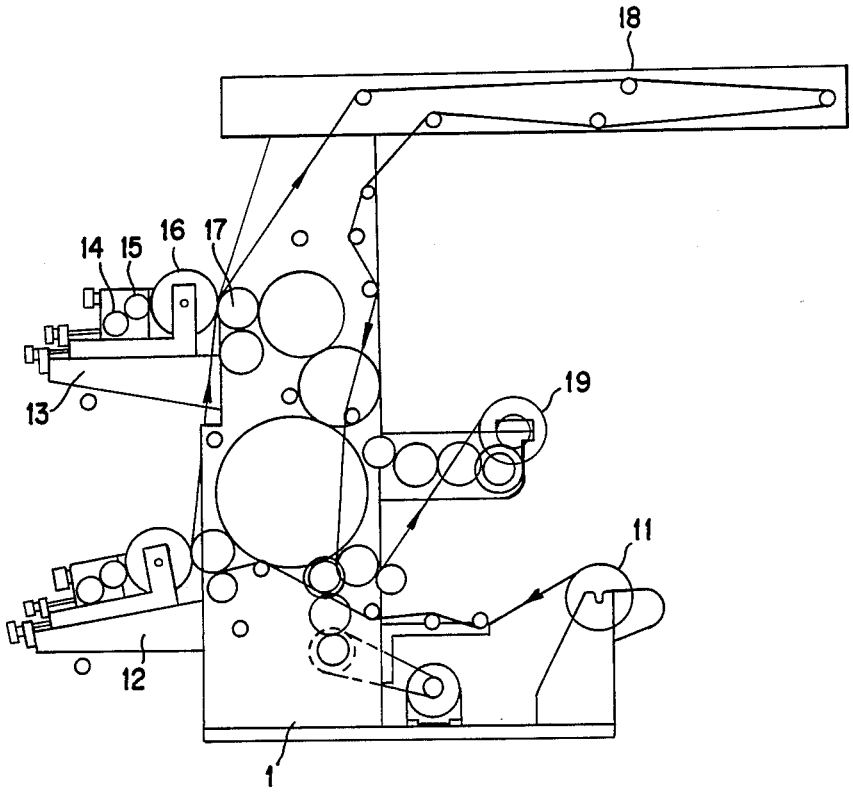
FIG. 3 PRIOR ART
FIG. 3 is a schematic illustration of a known plastic bag printing machine; and, FIG. 4 is an enlarged, fragmentary view, partial in section, of parts of the known printing machine illustrated in FIG. 3.
Figure 4:
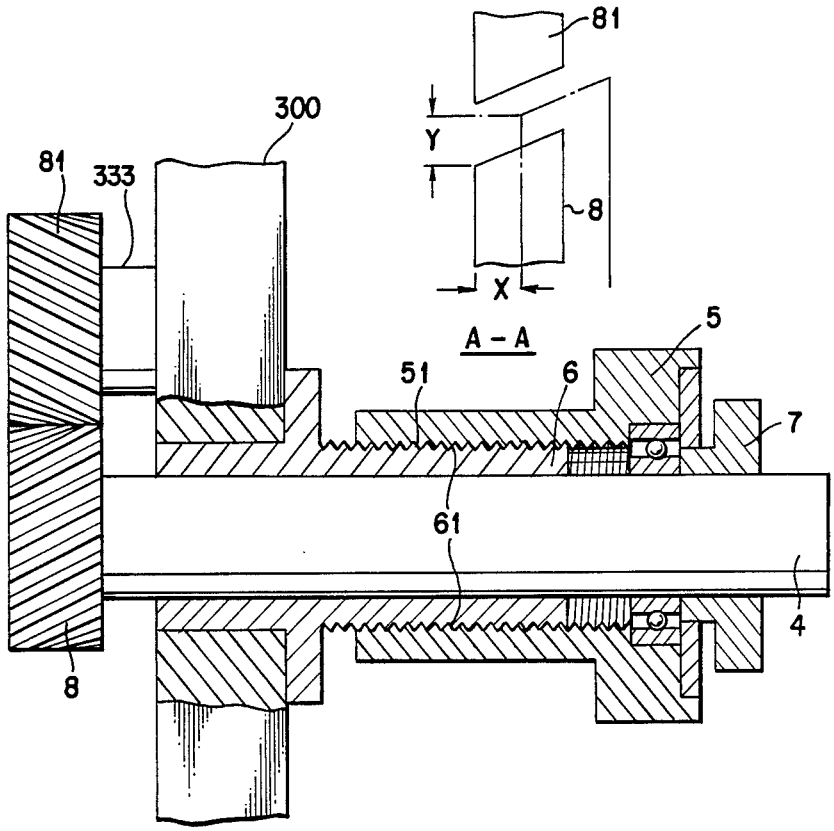
FIG. 4 PRIOR ART

Thus, the clutch slip plate 24 as has been described is sleeved on the driving shaft 25 and secured to the main gear 28 by a screw 101, as shown in FIG. 2. The clutch ring as has been stated is sleeved on the driving shaft 25 over the pin 26 which is located in the pin cavity 251 extending axially on the driving shaft 25 and also in a complementary pin cavity (not shown) on the inside of the clutch ring 21. This combination of elements allows the clutch ring 21 to rotate in concert with the driving shaft 25. When it is determined to drive the main gear wheel 28 with the driving shaft 25, electrical power is supplied to the electromagnetic member 23 of the clutch 122 and electric power is not supplied to clutch 2. This then forces the clutch ring 21 into engagement with the clutch slip plate 24 which drives the main gear 28. The second clutch 2 includes second stationary portion 132 which has attached to it second electromagnetic member 123. The second stationary portion 132 is fixed to housing extension 64 and is adjacent a second clutch ring 121 which is located on the driving shaft 25 by second pin 126 which fits into pin cavities formed on the driving shaft 25 and on the inside of the second clutch ring 121. A second clutch slip plate 124 is secured to the adjustment gear wheel 29 and is mounted adjacent to the second clutch ring 121. When it is determined to drive the adjustment gear wheel 29 by the driving shaft 25, electrical power is not supplied to the first clutch 122 but is supplied to electromagnetic member 123 of the second clutch 2. This forces the clutch ring 121 into engagement with the second slip plate 124 which drives the adjustment gear wheel 29. Adjustment gear wheel 29 therefore drives second transmission gear wheel 32, with which it meshes, and first transmission gear wheel 31. The first transmission gear wheel 31 in turn drives main gear wheel 28, with which it meshes, which in turn drives driven gear wheel 41 causing plate cylinder 16 to rotate at a speed difference relative to pressing cylinder 17 as a function of the gear ratio difference between adjustment gear 29 and second transmission gear wheel 32 and that between main gear wheel 28 and first transmission gear wheel 31.

Accordingly, when the driving shaft 25 rotates, the adjustment gear wheel 29 transmits force with 64 teeth to the first transmission gear wheel 31, as a result of which the transmission shaft 33 of the transmission means 3 rotates at $1 \div 65X <$ per revolution of gear wheel 29 as compared to main gear wheel 28 which has 65 teeth.

The main gear 28 and both the first and second transmission gear wheels 31 and 32 have 65 teeth while the adjustment gear wheel 29 preferably has 64 teeth. Thus, if the number of teeth in the driven gear wheel 41 equals that of the main gear wheel 28, a difference in speed will occur between the plate cylinder 16 and the pressure roller 17 when the adjustment gear wheel 29 provides the driving force from driving shaft 25 to provide the necessary adjustment for obtaining color registration between printing means of a plastic bag printing machine.

Thus, when the first clutch 122 is engaged and the second clutch 2 is disengaged, the main gear 28 drives the driven gear wheel 41 which drives the plate cylinder 16. The main gear wheel continues to drive the first and second transmission gear wheels 31 and 32 and the adjustment gear wheel 29, however, the adjustment gear wheel 29 is freewheeling and not operative. As has been described, the first and second clutches are operated mutually exclusive, such that when the second clutch is engaged and the first clutch 122 is disengaged, the adjustment gear 29 is driven directly by the driving shaft 25. Each complete rotation of the adjustment gear wheel 29, since it has fewer teeth than the transmission gear wheels, and the main gear wheel 28, causes the transmission gear wheels 31 and 32, and the main gear wheel 28, along with driven gear 41, and plate cylinder 16, to rotate relatively more slowly than the driving shaft 25 and the pressing cylinder 17 attached thereto. When the main gear 28 is driven directly from shaft 25, then there is no relative difference in the speed between the plate cylinder 16 and the pressing cylinder 17. The ability to adjust the speed of the plate cylinder 16 relative to the pressing cylinder 17, between which the plastic bags pass, allows for registration adjustment of the printing of one color by a printing means relative to a color previously applied in the plastic bag printing machine.

It is to be noted that the above description aims to explain, however, not to limit the concept of this invention.

What is claimed is:

1. An adjustment apparatus for adjusting the speed of a plate roller relative to a pressing roller, between which plastic bags pass in a plastic bag printer, comprising:

clutch means mounted on a driving shaft, said pressing roller being mounted on one end thereof, said clutch means comprising a first clutch and a second clutch each including a stationary plate fixed on a housing, said clutch means further including a clutch ring and a clutch slip plate, said stationary plate being provided with an electromagnetic member thereon for the mutual exclusive operation of said first and said second clutches;

transmission means comprising a transmission shaft, a first transmission gear wheel and a second transmission gear wheel, said first and second transmission gear wheels being fixedly coupled to said transmission shaft;

a main gear wheel rotatably mounted on said driving shaft and being coupled thereto by said first clutch when said electromagnetic member of said first clutch is energized, said main gear wheel being in engagement with said first transmission gear wheel;

an adjustment gear wheel rotatably mounted on said driving shaft adjacent to said main gear wheel, said adjustment gear wheel being in engagement with said second transmission gear wheel and being made operative by said second clutch;

a driven gear coupled to one end of said plate roller, said driven gear being in engagement with said main gear wheel for maintaining a rotational speed of said plate roller relative to said pressing roller.

2. An adjustment apparatus as recited in claim 1 wherein the number of teeth of said main gear wheel is greater than that of said adjustment gear wheel.

3. An adjustment apparatus as recited in claim 2 wherein the number of teeth of said main gear wheel is equal to that of said first and second transmission gear wheels.

4. An adjusting apparatus as recited in claim 1 where said main gear wheel, said first and said second transmission gear wheels each have 65 teeth while said adjustment gear wheel has 64 teeth.

5. Apparatus for adjusting the color registration of a printer by adjusting the relative speed between a pair of roller comprising a pressing cylinder and a plate cylinder driven in synchronism by drive means, one of the rollers defining a first cylinder being driven form the drive means by a first transmission means, the first transmission means including (1) a main gear rotatably mounted on a driving shaft, (2) a first clutch for engaging the main gear with the driving shaft and (3) a driven gear driven by the main gear for driving said first cylinder, second transmission means between the drive means and a second cylinder defined by the other of said pair of rollers, the second transmission means including (1) an adjustment gear rotatably mounted on the driving shaft, (2) a second clutch for engaging the adjustment gear with the driving shaft when the first clutch is disengaged, (3) a first transmission gear mounted on a transmission shaft for driving the main gear about the driving shaft so as to drive said first cylinder through said driven gear and (4) a second transmission gear mounted on the transmission shaft in driving relationship with said adjustment gear, and control means actuable temporarily to disengage the first transmission means and engage the second transmission means, the second transmission driving said second cylinder out of synchronism with said first cylinder, so as relatively to adjust the cylinders.

6. Apparatus according to claim 5, wherein the first transmission gear and the main gear have a gear tooth ratio therebetween differing from a gear tooth ratio between the second transmission gear and the adjustment gear.

7. Apparatus according to claim 6, wherein the main gear and the first and second transmission gears have 65 teeth while the adjustment gear has 64 teeth.

* * * * *